United States Patent [19]

Finkbeiner

[11] 4,330,089

[45] May 18, 1982

[54] ADJUSTABLE MASSAGE SHOWER HEAD

[75] Inventor: Werner Finkbeiner, Schiltach, Fed. Rep. of Germany

[73] Assignee: Hans Grohe GmbH & Co. KG., Fed. Rep. of Germany

[21] Appl. No.: 133,593

[22] Filed: Mar. 24, 1980

[30] Foreign Application Priority Data

Mar. 23, 1979 [DE] Fed. Rep. of Germany ..... 2911405

[51] Int. Cl.[3] ..... B05B 1/34

[52] U.S. Cl. ..... 239/383; 239/440; 239/441; 239/447; 239/449; 239/458; 239/460

[58] Field of Search ..... 239/383, 440, 441, 447–449, 239/456–458, 460, 102

[56] References Cited

U.S. PATENT DOCUMENTS

| | | | |
|---|---|---|---|
| 3,929,287 | 12/1975 | Givler | 239/447 |
| 4,151,957 | 5/1979 | Gecewicz et al. | 239/447 |
| 4,204,646 | 5/1980 | Shames et al. | 239/449 |

FOREIGN PATENT DOCUMENTS

| | | | |
|---|---|---|---|
| 2409315 | 1/1975 | Fed. Rep. of Germany | 239/383 |
| 2819945 | 11/1978 | Fed. Rep. of Germany | 239/383 |

*Primary Examiner*—Robert B. Reeves
*Assistant Examiner*—Michael J. Forman
*Attorney, Agent, or Firm*—McGlew and Tuttle

[57] ABSTRACT

An adjustable massage shower head comprising, a housing defining a liquid input chamber for receiving a liquid, a flow guide mounted for axial movement in the housing defining a liquid flow passage from the input chamber and a turbine chamber, the flow guide having a spray bottom connected thereto with openings therethrough. A rotor valve is rotatably mounted and fixed at an axial position to the housing and disposed in the turbine chamber for rotation which produces a pulsating spray from the openings. A ring wall is disposed around the turbine chamber and has a plurality of ducts extending radially at an oblique angle therethrough for directing liquid against the rotor valve. The flow guide is axially movable to direct liquid against increasing areas of the rotor valve to increase the frequency of the pulsing spray. A valve disc is also connected to the housing in the flow guide for diverting the flow of liquid from the turbine chamber to a second flow passage around the flow guide to form a continuous spray which is adjustable with further axial movement of the flow guide.

13 Claims, 5 Drawing Figures

FIG.3
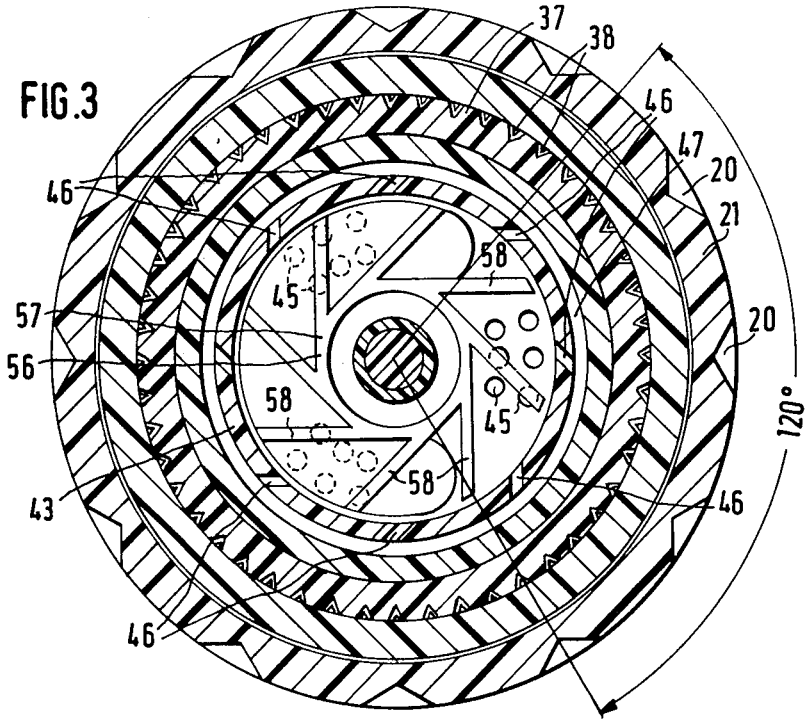
FIG.4
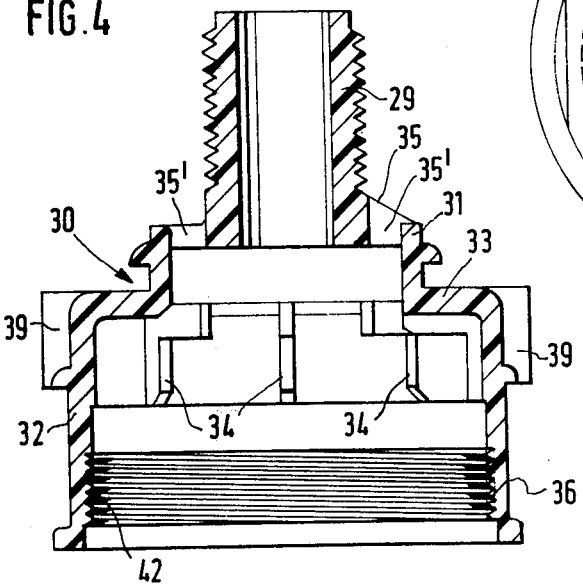
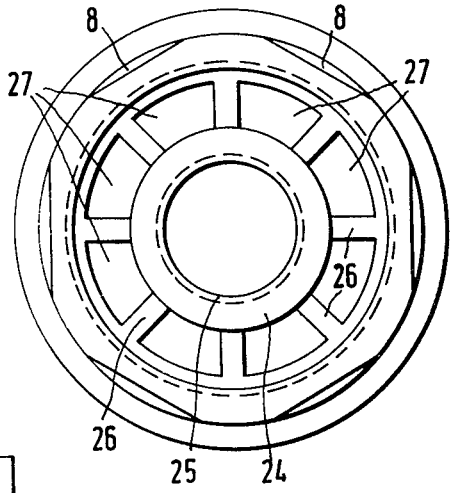
FIG.5

ADJUSTABLE MASSAGE SHOWER HEAD

FIELD AND BACKGROUND OF THE INVENTION

The present invention relates in general to adjustable shower heads and, in particular, to a new and useful adjustable massage shower head which, with one adjusting action, can adjust a spray from a slow pulsating spray to a more rapidly pulsating spray to a needle sharp continuous spray and finally to a soft continuous spray.

In one known adjustable massage shower head (DE-OS No. 27 22 967), a valve rotor is disposed directly in the interior of the tubular body and rotatably mounted in the spray bottom by means of a bearing pin so that it is moved axially together with the tubular body when the shower head is switched from pulsating to nonpulsating spray or vice versa. The distributing element consists of a pipe nipple with a central bore on the inflow side, which bore is closed on the opposite face by a face wall and selectively connectable through radial slots either to the interior of the tubular body or else to the housing cavity surrounding the tubular body. For this purpose there is fastened to the upper end of the tubular body a cylindrical collar which encloses the pipe nipple and is axially movable relative to the latter and which also has radial holes capable of establishing the connection between the radial holes of the pipe nipple and the interior of the tubular body. In the axial end positions of this cylindrical collar or of the tubular body, only one each of the two possible spray types is produced, namely either the pulsating spray or the nonpulsating spray.

It should be possible in such massage shower heads to be able to vary the rotary speed of the valve rotor and, hence, the pulsation frequency of the pulsating water spray while the liquid throughput remains approximately constant. This known massage shower head has no such capability.

Massage shower heads with such capabilities are however already known. These also offer the additional possibility of producing selectively pulsating and nonpulsating liquid sprays. Such a massage shower head is known from DE-PS No. 24 09 315, for example. This massage shower head has two groups of spray channels, one group of which consists of axis-parallel longitudinal slots disposed on the circumference of a spray ring while the other group consists of spray holes disposed in a spray bottom, above which a valve rotor rotates, opening and closing them alternately. The switching device by means of which the switch from pulsating to nonpulsating sprays can be made, consists of a valve assembly comprising a round disc with various flow-through channels which can selectively be closed or opened by means of a covering device rotatable relative thereto. A total of three flow channels is formed, one of which conducts the flow-through medium directly to the spray channel group which produces a nonpulsating spray while the other conducts the flow-through medium through tangential guide channels to the blades of the valve rotor in a turbine chamber, whence the medium discharges in the form of pulsating jets through the second group of spray channels. A third channel which also leads through flow-through channels of the round disc, which can be selectively covered, is provided to reduce the rotary speed of the valve rotor and, hence, the pulsation frequency of the pulsating spray. If this third channel is open, a part of the flow medium is branched off the above mentioned second channel and conducted axially into the turbine housing so that, while the same amount of medium still gets into the turbine housing, the medium component effecting the rotation of the valve rotor is reduced. This causes the valve rotor to rotate more slowly, reducing the pulsation frequency accordingly.

Apart from the fact that, in this arrangement, the desired effect of varying the pulsation frequency is relatively minor and dependent a great deal on the prevailing flow pressure, there is the danger that the rotor stops or even fails to start when the third channel is open all the way. Moreover, to build this assembly, a great many components of complicated shape and correspondingly high assembly costs are unavoidable.

In another known massage shower head (DE-OS No. 28 19 945) of a design similar to that just described, there is disposed, for the variation of the pulsation effect, i.e. of the intensity of the pulsating water sprays, between the valve rotor and the pulsation-generating spray holes in the spray bottom of the turbine chamber, a disc, mounted on a concentric pin and equipped with segment-shaped cutouts, it being possible, by turning this disc, to close a part of the spray holes. Due to the reduced pressure buildup, the water spray is softer when all spray holes are open and correspondingly harder when a part of these spray holes is closed. To rotate this closing disc, a separate rocking lever is provided which communicates via gears with a toothed hub and with the closing disc. Here again, the cost for parts of partly very complicated shape and for the assembly is considerable while the effect achieved, on the other hand, is relatively poor.

For the purpose of obtaining sprays of different hardness it is also known in a shower head generating pulsating sprays only (U.S. Pat. No. 2,878,066) to make a valve rotor, equipped with turbine blades and segment-shaped closing discs, adjustable in its spacing from a spray disc by means of an axially movable bearing screw. A variation of the pulsation frequency is not achievable with this arrangement, however. Moreover, moving the bearing screw, thereby changing the spray quality, can be accomplished only in the disassembled state of the shower head.

SUMMARY OF THE INVENTION

It is an object of the present invention to provide an improved massage shower head with few components of simple design so that, with constant liquid throughput, the pulsation frequency is variable within a wider range of variation on the one hand and, without additional means, the spray intensity of both the pulsating and nonpulsating sprays can also be adapted better to the respective requirements, on the other.

According to the invention, this problem is solved in that a spray bottom, provided with a ring wall containing obliquely radial or tangential turbine ducts and emitting the pulsating spray, is movable with the stationarily positioned valve rotor in an axial direction so that, when the connection between an inflow chamber and the spray slots is interruped, the axial overlap of the valve rotor turbine blades with the ducts is variable between two extreme positions.

The main advantage achieved thereby is that merely by moving the spray bottom axially relative to the valve rotor, the possibility is provided of varying the braking moment counteracting the rotary drive of the valve rotor due to the fact that the underside of the valve rotor sits directly on the spray bottom in the one axial position of the bottom, thus being subjected to a greater braking friction moment than in another axial position of the spray bottom in which the valve rotor is lifted off the spray bottom and rotates with considerably less bearing friction. Substantial speed differences are obtainable thereby. By moving the spray bottom axially relative to the valve rotor, the turbine ducts of the rotor are also brought into a different position in which the obliquely radial flows generated by them, which are directed against the turbine blades, impinge the turbine blades fully or only partially, thus resulting in an additional regulating effect with respect to the valve rotor speed. At the same time, the variability of the distance between the spray bottom generating the pulsating spray and the valve rotor or its closing member also results in the possibility of varying the characteristic of the pulsating spray with respect to its intensity or its hardness or softness.

In a further development of the invention in which the valve rotor is stationarily positioned axially in the housing and the spray bottom is movable axially, there results the advantage that, with the same manually operable means, the spray ring generating the nonpulsating spray can be moved axially together with the spray bottom in order to also vary the nonpulsating spray with regard to its characteristic, due to the tapered form of the spray slots disposed on the circumference of the spray ring, as is already known in other shower heads of similar design.

Accordingly an object of the present invention is to provide an adjustable massage shower head comprising, a housing defining a liquid input chamber for receiving a liquid, a flow guide mounted for axial movement in the housing defining a liquid flow passage from the input chamber and a turbine chamber, a spray bottom connected to the flow guide and defining one wall of the turbine chamber having openings therethrough, a rotor valve rotatably mounted at an axial position to the housing and in the turbine chamber, the rotor valve rotatable over the openings of the spray bottom to produce a pulsating spray of liquid from the turbine chamber, a ring wall connected to the flow guide between the liquid flow passage and the turbine chamber having at least one obliquely extending duct therethrough, and means for axially moving the flow guide in the housing to move the spray bottom and ring wall with duct from a position with the duct directing liquid from the flow passage to a portion of the rotor valve, to a position with the duct directing liquid to increasing portions of the rotor valve whereby the pulsing spray is increased in frequency.

A further object of the present invention is to provide such an adjustable massage head which includes a valve disc fixed to the housing and positioned in the flow guide to cut off flow of liquid into the liquid flow passage at a selected axial position of the flow guide, the flow guide defining with the housing a second flow passage, the flow guide including a spray ring connected thereto and cooperating with the housing to form a continuous spray, the spray ring having a plurality of nozzle grooves therein of a shape to change the characteristic of the spray with continued axial movement of the flow guide.

A further object of the present invention is to provide an adjustable massage shower head which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 3 is a section of FIG. 1 taken along the plane III—III of FIG. 1;

FIG. 4 is a side sectional view of a hollow cylindrical guide part of the invention of FIG. 1; and FIG. 5 is a top view of a tubular body part of the invention of FIG. 1.

DETAILED DESCRIPTION OF THE PREFERRED EMBODIMENT

Figure 1:
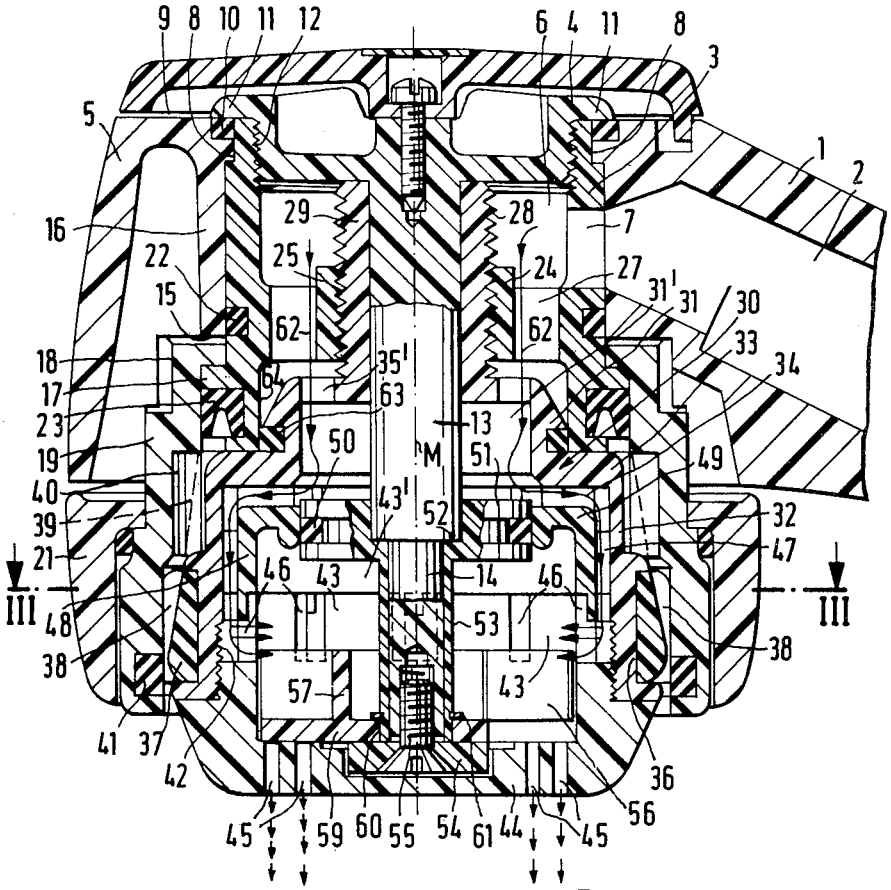
FIG. 1 is a side sectional view of a massage shower head in accordance with the invention.

The massage shower head shown in the drawings comprises a hand-held shower head having a handle 1, shown only in part. Water is supplied through the bore 2 of handle 1, and conducted into a hollow-cylindrical guide part 3 which is fastened by means of a screw cover 4 in the external head housing 5 which is an integral part of the handle 1. The internal distribution chamber 6 of the guide part 3 communicates with the bore 2 of handle 1 through a radial hole 7. At its upper end, the guide part 3 has several arc-shaped guide surfaces 8 (see FIGS. 1 and 5) seated in a corresponding matching profile of the head housing 5 to assure that the guide part 3 cannot turn in the head housing 5. The screw cover 4 has a flange 11 which rests on the upper face 9 of the head housing 5 or on a sealing ring 10 and is screwed from the top into the guide body 3 by means of a thread 12. Furthermore, the screw cover 4 is provided with a central, cylindrical pin 13 which extends substantially over the entire axial length of the shower head and has at its lower end a thinner, cylindrical extension 14.

Between a lower limiting face 15 of an inner wall 16 of the head housing 5 which accommodates the guide part 3, and an outwardly projecting annular shoulder 17 of part 3, is disposed an inwardly projecting annular shoulder 18 of a cylindrical, rotating part 19. Cylindrical rotating part 19 has several sections of different diameter and is provided with a ring 21 which in turn is provided with gripping grooves 20 (see FIGS. 1 and 2). Ring 21 is fixedly secure against rotation on part 19. The guide part 3 is sealed by means of an O-ring 22 and a fluted ring seal 23, against the inside wall 16 and against the rotating part 19 respectively.

The guide part 3 has a threaded hub 24 with an internal thread 25. The hub 24 is joined to the wall of the guide part 3 by radial webs 26 (see FIGS. 1 and 5) which form flow-through openings 27 therebetween.

A hollow pin 29 is screwed into the threaded hub 24 for rotation thereon, which hollow pin 29 has an external thread 28 and is guided so as to be axially movable on the cylindrical pin 13 of the screw cover 4. The hollow pin 29 is an integral part of a flow guidance part 30 which consists of a hollow cylindrical collar 31 and a cylindrical tube section 32 which is larger in diameter than the collar 31. Between the tube section 32 and the collar 31 there is a radial, annular shoulder 33 whose underside is provided with a number of spacer ribs 34 extending partially radially and partially axially along the inside wall of the tube section 32 (see FIGS. 1 and 4). The flow guidance part 30 is shown in section in FIG. 4, in which the spacer ribs 34 can also best be seen. Axial flow-through openings 35', formed by radial webs 35, provide a path for liquid flowing from the distribution chamber 6 from the flow-through openings 27 of the guide part 3 into the interior of the collar 31. Openings 35' are located between the collar 31 and the hollow pin 29. Fastened in an annular slot 36 disposed in the lower region of the tube section 32 and on its outside diameter, is a spray ring 37 on whose outside surface are provided a large number of equispaced tapered spray slots 38 which are triangularly profiled and extend axially, and through which the water can be dispersed in continuous jets.

Provided above the annular slot 36 on the tube section 32 are radially projecting driver ribs 39 which grip between driver ribs 40 of the rotating part 19 projecting radially inward so that there is a sliding connection between the flow guidance part 30 and the rotating part 19, which connection permits an axial motion of the flow guidance part 30 relative to the rotating part 19, with rotation of the guidance part 30.

The outside surface of the spray ring 37 is in close association with a sealing ring 41 of the rotating part 19 so that the flow-through section of the spray slots 38 is precisely defined in every axial position of the flow guidance part 30 or of the spray ring 37.

The lower end of the flow guidance part 30 has an internal thread 42 into which is screwed a spray bottom 44 provided with a ring wall 43. Located in the spray bottom at certain radial minimum spacings from the centerline M are spray holes 45 which extend axially and which, as may be seen from FIG. 3, are disposed in groups of 6 each on an annular surface of the spray bottom 44, the groups being circumferentially spaced or staggered by a mean angular distance of 120°.

Located in the ring wall 43 are turbine ducts 46 which extend obliquely radially tangentially and connect an annular canal 47 between the tube section 32 and the flow guidance wall 43. To extend the cylindrical interior of the ring wall 43 axially, there is mounted, flush on the ring 43, an annular part 48 which is provided, at its upstream end with an annular shoulder 40, projecting radially inward and contacting the radially extending sections of the spacer ribs 34 so that there originate, between the spacer ribs 34, radial connecting channels between the interior 31' of the collar 31 and the annular canal 47.

A cylindrical valve closing disc 51 is securely fixed at a certain axial distance from the threaded hub 24 of the guide part 3, on the pin 13. Valve closing disc 51 is provided with a sealing ring 50 and has an outside diameter which is so matched to the inside diameter of the collar 31 of the flow guidance part 30 and to the inside diameter of the annular shoulder 49 of the annular part 48 mounted on the ring wall 43. The sealing ring 50, when in contact with one of these two inside surfaces, prevents the flowthrough of water. The valve closing disc 51 rests against an extension or shoulder 52 of the pin 13 on one side and, on an opposite side, has a tubular extension 53 which sits on a bearing pin 54. The bearing plate 54 is fastened by means of a screw 55 screwed into a lower end of the cylindrical extension 14 of pin 13.

A valve rotor 56 is disposed in the cylindrical cavity formed by the ring wall 43 and the annular part 48, which cavity forms a turbine chamber. The valve rotor 56 has a number of turbine blades 58 (see FIG. 3) extending tangential to a cylindrical hub 57, and a circular closing disc 59 which has interruptions or segment-like cutouts over an angular range of about 60° and a central bore of the diameter of the tubular extension 53. Rotor 56 is mounted on the tubular extension 53 or the bearing plate 54 so as to turn freely. To secure the valve rotor 56 also against shifting axially in the direction of the valve closing disc 51, which is no absolute necessity, however, a retaining ring 61 is placed on the tubular extension 53 above the closing disc 59 so that the valve rotor is provided with adequate axial play.

Figure 2:
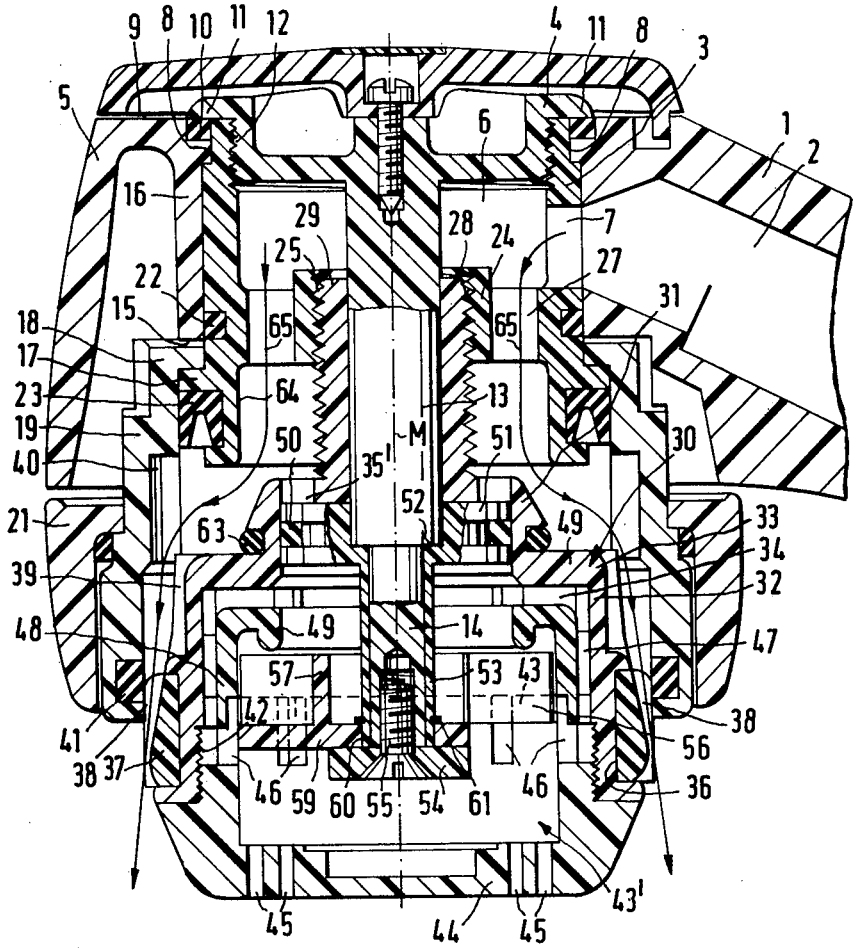
FIG. 2 is a view similar to FIG. 1 of the same massage shower head except in a different functional position.

The two possible extreme positions of the flow guidance part 30 and of the parts connected to it are shown in FIGS. 1 and 2, respectively. In FIG. 1, the hollow pin 29 of the flow guidance part 30 is screwed completely into the threaded hub 24 of the guide part 3. Accordingly, the flow guidance part 30 assumes its "uppermost" position (relative to the view in FIGS. 1 and 2). The sealing ring 50 of the valve closing disc 51 then rests against and seals the inside wall of the annular shoulder 49 so that the distribution chamber 6 of the guide part 3 communicates with the turbine chamber 43' through the flowthrough openings 27 and 35', the cavity 31', the annular canal 47 and the tubine ducts 46, and the water flowing in from the bore 2 of handle 1, travels as indicated by the arrow lines 62. In this position, only a part of the flow is conducted to the turbine blades 58 through the turbine ducts 46 so that the drive torque is relatively low. Furthermore, in this uppermost position of the flow guidance part 30, a larger diameter of the closing plate 59 of the valve rotor 56 rests on the inside surface of the spray bottom 44 so that also a relatively great friction braking moment acts upon the valve rotor 56, hence making only a low rotary speed of the valve rotor 56 attainable overall. In this position, most of the rotor 56 is disposed below the ducts 46.

By manually turning the ring 21 and the flow guidance part 30 which is joined to it flush through the rotating part 19, and flow guidance part 30 and the spray bottom 44 fixed to it are moved axially down relative to the valve rotor 56 on account of the thread engagement between the hollow pin 29 and the threaded hub 24. The valve rotor 56 does not follow this axial motion because it sits on the bearing plate 54. The effect of this downward motion of the spray bottom 44 is not only that the latter lifts off the valve rotor 56, thereby reducing the braking friction moment, but also that the turbine ducts 46 move gradually into the axial range of the turbine blades 58 completely so that they are fully acted upon by the rotating flow. Thus, an acceleration effect is exerted on the valve rotor 56 in two respects so that a transition from a minimum to a maximum speed of the valve rotor 56 takes place. A speed increase comes about at the moment the friction between the valve rotor 56 and the spray bottom 44 is interrupted and the valve rotor 56 sits only on the bearing plate 54, whose diameter is considerably smaller than the annular surface of the spray bottom 44.

The ring part 48, with its annular shoulder 49, also moves with the spray bottom 44 and the flow guidance part 30, relative to the stationary valve closing disc 51. As may be seen from FIGS. 1 and 2, the annular shoulder 49 has an inside surface of a certain axial extent so that, over an initial distance of the downward motion of the flow guidance part 30, the liquid inflow to the annular canal 47 is neither reduced nor inhibited. But as the downward motion of the flow guidance part 30 continues, the valve closing disc 51 arrives at the level of the radially extending connecting channels formed by the spacer ribs 34 and finally in the collar 31 so that the inflow of liquid to the annular canal 47 and, hence, to the valve rotor 56 or to the spray bottom 48 is completely cut off.

As long as the supply to the spray bottom 44 or the turbine chamber 43' continues, and the valve rotor 56 rotates, a pulsating spray, the pulsation frequency of which depends on the rotary speed of the valve rotor 56, is generated due to the cyclic opening and closing of the spray holes 45 through which the water discharges.

The outside of the collar 31 is provided with a sealing ring 63 which, in the uppermost position of the flow guidance part 30, rests in sealing fashion against a cylindrical wall surface 64 of the guide part 3 and which is being moved relative to the guide part 3 by the axial motion of the flow guidance part 30. The configuration of the sealing ring 63 in the collar 31 of the flow guidance part 30 may be such that it leaves the cylindrical wall surface 64 during the downward motion of the flow guidance part 30 before the annular shoulder 49 has left the sealing ring 50 of the valve closing disc 51 so that both pulsating and nonpulsating sprays can be generated in an intermediate position of the flow guidance part 30, or the sealing ring 63 may be disposed so that it leaves the wall surface 64 only after the inner wall surface of the collar 31 has already reached the sealing ring 50 of the valve closing disc 51. In that case there are only the two possibilities of generating either pulsating or nonpulsating sprays.

As soon as the sealing ring 63 leaves the wall surface 64 during the downward motion of the flow guidance part 30, a flow connection between the distribution chamber 6 or the flowthrough openings 27 abd the spray slots 48 of the spray ring 37 comes about so that non-pulsating sprays discharging from the spray slots 38 of the spray ring 37 are generated also, or omly. FIG. 2 shows the opposite extreme position of the flow guidance part 30 in comparison to that of FIG. 1, in which the liquid supply to the annular canal 47 and thus to the turbine chamber is blocked completely and the liquid can discharge through the spray slots 30 only, the liquid flowing through the shower head along the arrow lines 65.

It is evident from FIG. 2 that, in the lowermost extreme position of the flow guidance part 30 and of the spray ring 37, the sealing ring 50 in the valve closing disc 51, which shuts off the supply of liquid to the turbine chamber, has penetrated the collar 31 by a certain distance in axial direction and is spaced a certain distance from its lower edge, which means that the flow guidance part 30 with the spray ring 37 can be moved up and down over the distance corresponding to this spacing, without thereby changing the liquid supply to the spray ring. Due to the fact that the spray slots 38 of the spray ring 37 are tapered in the axial direction, the possibility exists to vary the spray characteristic of the nonpulsating sprays with respect to their "sharpness" of the spray by moving the flow guidance part 30 axially within the said range.

It should yet be noted that the pulsating sprays are also variable in regard to their "sharpness" or "hardness", regardless of the pulsation frequency, by changing the distance between the closing disc 59 of the valve rotor 56 and the spray bottom 44. A greater distance produces "softer" sprays, and when the distance is very short or zero, the resultant sprays are the "hardest" or "sharpest".

Accordingly, the massage shower head of the invention is capable, with a single operating member only, namely the turning member 21, of adjusting for both pulsating and non-pulsating sprays as well as for soft and hard pulsating and soft and hard non-pulsating sprays.

While specific embodiment of the invention has been shown and described in detail to illustrate the application of the principles of the invention, it will be understood that the invention may be embodied otherwise without departing from such principles.

What is claimed is:

1. An adjustable massage shower head comprising:

a housing defining a liquid input chamber for receiving a liquid;

a flow guide mounted for axial movement in said housing defining a liquid flow passage from said input chamber and a turbine chamber;

a spray bottom connected to said flow guide and defining one wall of said turbine chamber having openings therethrough;

a rotor valve rotatably mounted to said housing and in said turbine chamber, said rotor valve having a cutout-segment and being rotatable over said openings to produce a pulsating spray of liquid leaving said turbine chamber as said cutout-segment passes over said openings;

a ring wall connected to said flow guide between said liquid flow passage and said turbine chamber having at least one obliquely extending duct therethrough and means for axially moving said flow guide in said housing to move said spray bottom and ring wall with said at least one duct from a position with said duct directing liquid from said flow passage to a portion of said rotor valve, to a position where said duct directs liquid to an increased portion of said rotor valve, whereby the pulsating spray is increased in frequency.

2. A shower head according to claim 1, including a spray ring having a plurality of circumferentially spaced slots therein connected to said flow guide and defining with said housing a non-pulsating spray nozzle, said flow guide defining with said housing a second liquid flow passage between said input chamber and said non-pulsating spray nozzle.

3. A shower head according to claim 2, including a valve disc connected to said housing and engaged with said flow guide for defining said first mentioned liquid flow passage at one axial position of said flow guide and for cutting off flow in said first mentioned liquid flow passage and permitting flow in said second liquid flow passage at another axial position of said flow guide.

4. A shower head according to claim 2, wherein said slots are shaped to change a characteristic of an unpulsating spray from said unpulsating spray nozzle with axial movement of said flow guide.

5. A shower head according to claim 1, including a pin connected to said housing extending axially therein and into said flow guide, said pin rotatably carrying said rotor valve.

6. A shower head according to claim 5, further including a bearing plate connected to the bottom of said pin for rotatably supporting said valve rotor on said pin, said bearing plate having a diameter less than that of said spray bottom for permitting contact between a portion of said spray bottom and said rotor valve when said flow guide is in at least one axial position with respect to said housing.

7. A shower head according to claim 1, wherein said flow guide is axially movable by said means for moving said flow guide, to establishing frictional contact between said rotor valve and said spray bottom to reduce the rotation of said rotor valve due to flow of the liquid through said at least one duct.

8. A shower head according to claim 1, wherein said means for axially moving said flow guide comprise a pin connected to and extending axially in said housing, a hollow cylindrical tube connected to said flow guide and embraced around said pin having exterior threads, and a portion of said housing having interior threads threaded on said exterior threads of said tube, whereby rotational movement of said flow guide about said pin produces axial movement of said flow guide in said housing.

9. A shower head according to claim 8, including a manually rotatable ring rotatably mounted to said housing and engaged with said flow guide for rotational movement therewith and for permitting axial movement of said flow guide.

10. A shower head according to claim 9, wherein said flow guide includes a spray ring having a plurality of circumferentially spaced grooves therethrough defining with an interior surface of said manually rotatable ring a non-pulsing spray nozzle, said flow guide defining with said housing and said manually rotatable ring a second liquid flow passage between said input chamber and said non-pulsating spray nozzle.

11. A shower head according to claim 1, wherein said rotor valve comprises a valve plate rotatable in association with said spray bottom having a cutout portion movable over said openings for producing a pulsating spray through said openings, and at least one vane extending from said plate positioned to receive liquid from said at least one duct to produce rotation of said rotor valve.

12. A spray head for producing pulsating and non-pulsating sprays of liquid comprising, a housing having an input chamber, a flow guide mounted for axial movement in said housing defining a first flow passage and a second flow passage from said input chamber, a ring wall connected in said flow guide defining a turbine chamber, said ring wall with said flow guide defining an annular space communicating with said first flow passage, said ring wall having a plurality of obliquely extending turbine ducts therethrough communicating said annular space with said turbine chamber, a pin connected to said housing and extending axially through said flow guide and into said turbine chamber, a rotor valve rotatably mounted on said pin and in said turbine chamber, said flow guide movable axially to expose said rotor valve to increasing cross-sectional areas of said turbine duct to increase a frequency of pulsing spray from said turbine chamber, a spray bottom connected to said flow guide and forming a wall of said turbine chamber having openings therethrough, said rotor valve having a cutout segment and rotatable in association with said spray bottom to produce the pulsating spray, a valve disc connected to said pin extending radially outwardly therefrom and slidable against a portion of said ring wall, said valve disc positioned to close flow of liquid through said first flow passage at a selected axial position of said flow guide, communication established between said input chamber and said second flow passage with axial movement of said flow guide.

13. A spray head according to claim 12, including a tube connected to said flow guide slidably mounted on said pin and having external threads, said housing including a portion extending toward said tube having internal threads threaded on said external threads of said tube, said flow guide movable axially with rotation thereof.

* * * * *